US007677010B2

(12) United States Patent
Boots

(10) Patent No.: US 7,677,010 B2
(45) Date of Patent: Mar. 16, 2010

(54) MODULAR STRUCTURAL SYSTEM

(76) Inventor: Alfred H. Boots, 1113 S. Oak Park, Oak Park, IL (US) 60304

( * ) Notice: Subject to any disclaimer, the term of this patent is extended or adjusted under 35 U.S.C. 154(b) by 441 days.

(21) Appl. No.: 11/773,064

(22) Filed: Jul. 3, 2007

(65) Prior Publication Data

US 2009/0007500 A1 Jan. 8, 2009

(51) Int. Cl.
*F16B 7/00* (2006.01)
*E04C 3/00* (2006.01)

(52) U.S. Cl. ..... 52/655.1; 52/653.1; 52/656.9; 403/176; 403/169; 403/170; 403/171; 403/217; 403/218; 403/219

(58) Field of Classification Search ..... 52/648.1, 52/653.1, 653.2, 654.1, 655.1, 655.2, 656.9, 52/81.3; 403/169, 170, 717, 176, 217, 218, 403/219

See application file for complete search history.

(56) References Cited

U.S. PATENT DOCUMENTS 1,113,371 A * 10/1914 Pajeau ..... 446/126
1,471,520 A 10/1923 McCloy
2,001,215 A 5/1935 Ruppel
2,709,318 A * 5/1955 Benjamin ..... 446/103
2,846,809 A * 8/1958 Majewski ..... 446/92
3,002,590 A 10/1961 Hannoosh et al.
3,890,022 A 6/1975 Moon
3,912,410 A 10/1975 Pofferi
3,982,841 A 9/1976 Endzweig
4,012,153 A 3/1977 Pidgeon et al.
4,313,687 A 2/1982 Apeztegui et al.
4,322,176 A 3/1982 Johnson, Jr.
4,340,318 A 7/1982 Bush et al.
4,355,918 A 10/1982 Van Vliet
4,379,649 A 4/1983 Phillips
4,438,615 A 3/1984 Wendel
4,505,609 A 3/1985 Vella
4,516,376 A * 5/1985 King ..... 52/655.1
4,567,707 A * 2/1986 Herman ..... 52/653.1
4,633,566 A 1/1987 Coppa
4,637,193 A 1/1987 Lange
4,640,572 A 2/1987 Conlon
4,648,734 A 3/1987 Daus, Jr. et al.

(Continued)

OTHER PUBLICATIONS

Guard Rails, Hand Rails and Structural Fittings from McMaster-Carr, Catalog 101, pp. 876-879.

(Continued)

*Primary Examiner*—Brian E Glessner
(74) *Attorney, Agent, or Firm*—K&L Gates LLP

(57) ABSTRACT

A modular structural system includes a hub in the general shape of a polygon, such as a hexagon or octagon, which may be somewhat rounded or may have a regular shape. The system includes a plurality of other structural members, such as hub spokes, for interfacing adjacent the hub, and leg spokes, for interfacing with the hub or with the hub spokes. The system also includes cross braces for providing additional support between the hub spokes and leg spokes. The hub, the hub spokes, leg spokes, and cross braces are joined by bores in the individual pieces and a plurality of dowels or rods placed into the bores. From these modular pieces, and currently available structural members, many useful and recreational structures may be assembled and then disassembled, such as frames, garden structures, furniture, shelving, and the like.

24 Claims, 7 Drawing Sheets

U.S. PATENT DOCUMENTS 4,673,308 A * 6/1987 Reilly ..... 403/172
4,677,804 A 7/1987 Holt
4,766,712 A 8/1988 Hale
4,776,721 A * 10/1988 Lange ..... 403/171
4,822,199 A 4/1989 Nehls
4,864,795 A 9/1989 Burg
4,867,596 A 9/1989 Ocuin
4,915,532 A 4/1990 Radclyffe
4,923,322 A 5/1990 Burg
4,932,808 A 6/1990 Bar et al.
4,970,841 A * 11/1990 Zeigler ..... 52/646
5,051,019 A 9/1991 Kohl
5,116,160 A 5/1992 Pold et al.
5,125,206 A 6/1992 Motohashi et al.
5,127,758 A 7/1992 Kreusel
5,165,207 A 11/1992 Oehlke
5,310,273 A 5/1994 Hara
5,356,234 A 10/1994 Vangool
5,498,094 A * 3/1996 Imai ..... 403/171
5,549,408 A * 8/1996 Lo ..... 403/218
5,568,993 A 10/1996 Potzick
5,580,181 A 12/1996 Nomura
5,620,274 A * 4/1997 Wear ..... 403/171
5,640,811 A 6/1997 Boyle et al.
5,651,630 A 7/1997 Nomura
5,690,446 A * 11/1997 Poissant et al. ..... 403/361
5,700,102 A 12/1997 Feleppa
5,797,695 A * 8/1998 Prusmack ..... 403/170
5,839,248 A * 11/1998 Liang ..... 52/655.2
5,904,437 A 5/1999 Allen
6,082,837 A 7/2000 Battochio et al.
6,672,789 B2 * 1/2004 Chen ..... 403/171
6,702,640 B1 * 3/2004 Park ..... 446/85
6,722,086 B2 4/2004 Boots
6,854,238 B2 2/2005 Boots
6,857,247 B2 * 2/2005 Adams ..... 52/656.9
7,097,146 B2 * 8/2006 Tsai ..... 248/679
2003/0159368 A1 * 8/2003 Osterberg ..... 52/81.3
2005/0036829 A1 * 2/2005 Trull ..... 403/170
2007/0125033 A1 * 6/2007 Stephan et al. ..... 52/655.1

OTHER PUBLICATIONS

Kee Klamp Slip-on Pipe Fittings and Modular Storage Decking in catalog from Material Flow, Inc., Chicago, Illinois.
PCT International Search Report Dated Mar. 3, 2003 for PCT/US02/36910.
U.S. Appl. No. 11/458,321, filed Jul. 18, 2006, Boots.

* cited by examiner

FIG.12A
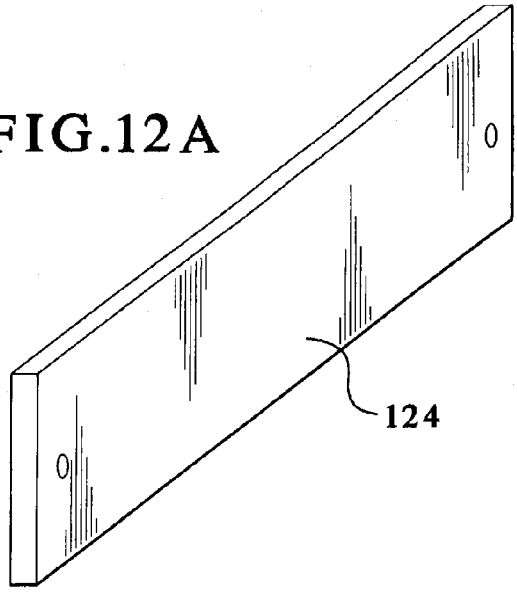
FIG.12B
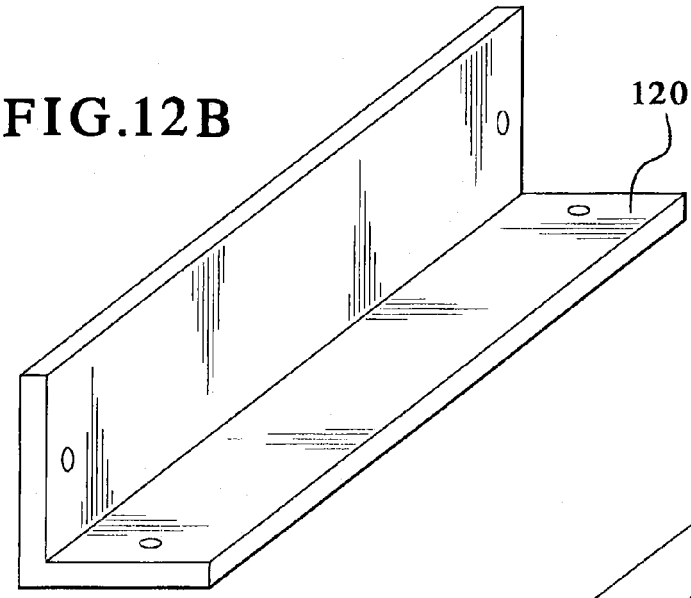
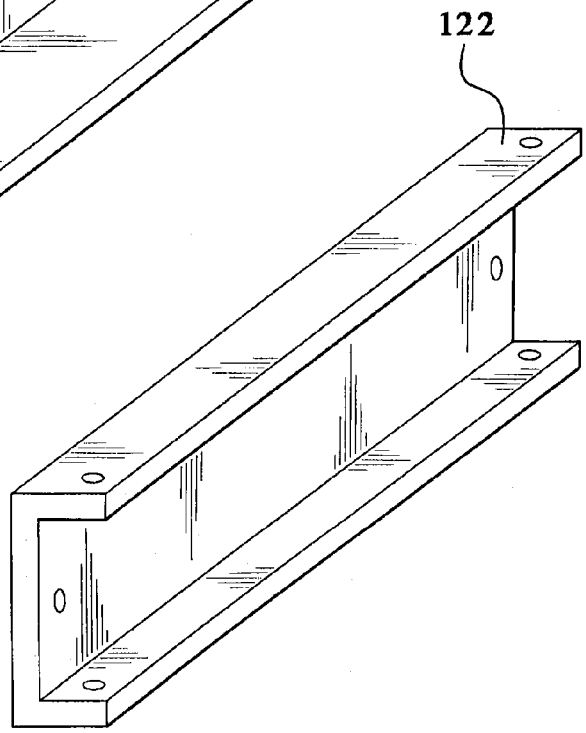
FIG.12C

MODULAR STRUCTURAL SYSTEM

CROSS REFERENCE TO RELATED APPLICATIONS

This patent is related to U.S. Pat. No. 6,722,086, titled "Modular Structure System," and to U.S. Pat. No. 6,854,238, titled "Structural Connection System for Frameworks," and to U.S. patent application Ser. No. 11/458,321, titled "Spherical Hub for Modular Structural System," all invented by Alfred H. Boots, the inventor of the subject matter disclosed and claimed herein. The entire contents of these patent documents are incorporated herein by reference for all purposes.

BACKGROUND

This patent generally relates to modular structural systems, and more particularly to generally polygonal three-dimensional hubs or connectors used in conjunction with modular structural systems.

Known modular structures generally include frame components or members configured for rapid assembly and disassembly. The frame members are required to (a) provide a durable and stable structure, and (b) be easy to handle and be installable by limited number of persons. The frame members can form a wide variety of shelter frames such as outdoor tents, circus tents, playground equipment, geodesic domes, greenhouses, swimming pool structures, etc. The frame members can also form internal structures, such as furniture, stands, shelving, etc.

Many known modular structural systems utilize and require telescoping members to assemble and disassemble a structure. These telescoping members are costly, complicated manufacture and tend to make the structure less rigid or strong. Some of those systems require inner and outer spring loaded tubes and a bolt or clamp that tightens the members together to form a member having a desired length. Other systems require an internal threaded rod or ball screw that cooperates with an internally threaded member. In operation, when the threaded member is turned relative to the rod or ball screw, the overall length of the member shortens or lengthens. Still other systems require a plurality of internal rods having threaded ends connected by a right angle gear and a second mating gear that couples to a handle, which extends outside of the member to enable an operator to turn the handle and thereby turn the rods to lengthen or shorten the member.

One known structural system disclosed in the above-identified U.S. Pat. No. 6,722,086 provides a modular system for constructing a tubular structure. The disclosed modular system provides for tubular structures to be assembled and disassembled in a direction perpendicular to a centerline of the tubing without having to move the tubing along its centerline. The modular system further allows the tubing to be positioned at various angles and allows curved tubing to be used. In an embodiment, the modular system includes a cylindrical hub and a connector that removably couples to the cylindrical hub. The connector has a first end that couples to the hub and a second that defines a notch. One of the walls of the notch connects to a flange that may extend in one or two directions from the centerline of the connector. The connector and flange removably couple to one end of an adapter, which contains a mating notch, wherein the adapter receives a tube.

Another known structural system disclosed in the above-identified U.S. Pat. No. 6,854,238 provides a modular frameworking system having various apparatuses and methods of attaching same. The disclosed framework includes a plurality of hubs which each include a plurality of pairs of opposing flat faces. Each face connects, in turn, to at least one connector. The disclosed frameworking system includes primary "T" shaped connectors that attach directly to the hubs and secondary "L" shaped connectors that attach to the primary connectors and thus the hub. An adapter is provided and connects at one end to a leg of the connector and at the other end to a structural member, e.g., a straight or curved tube, angle or channel. The adapter and structural member are readily removable from the hub and the connector. The connector can be curved and alternatively includes a hinge so that the connector can rotate. The connectors can attach to each face of the hub and can be rotated in multiple directions on any given face of the hub.

U.S. patent application Ser. No. 11/458,321, discloses spherical hubs, which make possible a variety of enclosed, three-dimensional structure. These structures, however, are somewhat limited because of the fairly wide space required to accommodate each node, and thus do not allow for more than a few spokes for each node. While each of these structural systems provides apparatuses and methods for assembling and constructing modular frameworks and structures, it would be desirable to provide a hub or core design that can further increase the flexibility and utility of these systems. Further, it would be desirable for the flexible hub to be simple and inexpensive to manufacture, thereby reducing the overall cost of the structural system in which it is utilized.

SUMMARY

One embodiment is a modular structural system. The modular structural system includes an elongated hub having a generally elongated polygonal shape, and further includes a longitudinal axis and a plurality of faces on a perimeter of the hub, the faces oriented along the axis, the hub also including two ends, and wherein each face and at least one end further including a bore. The system also includes at least one hub spoke, the hub spoke having a longitudinal axis and including a general shape of an elongated cylinder, an elongated cube or an elongated rectangle, with a first notch on a first end and a bore in the first notch substantially at right angles to the longitudinal axis, the bore proceeding from the notch to an outer surface of the first end, and a second end including second and third notches taken in a direction perpendicular to the first notch, such that the second end has a general shape of a rounded rectangle or square, and further including a bore substantially in the center of the second end. The system also includes at least one leg spoke, the leg spoke having a longitudinal axis and including a general shape of an elongated cylinder, an elongated cube, or an elongated rectangle, with a first notch on a first end and a bore in the notch substantially at right angles to the longitudinal axis, the bore proceeding from the notch to an outer surface of the first end, and a second end further including a bore in the longitudinal direction and substantially in the center of the second end, and a cross brace having a longitudinal axis, the cross brace in a general shape of a flat rectangle having a first flat end with a longitudinal bore substantially in the center of the first flat end, and a second rounded end, and further including a bore through the cross brace at about a right angle to the longitudinal axis.

Another embodiment is a modular structural system. The modular structural system includes a hub having a longitudinal axis and a plurality of faces on a perimeter of the hub, the faces oriented along the axis, the hub also including two ends, wherein a plurality of faces and each end further includes a bore, and at least one hub spoke, the hub spoke having a longitudinal axis and including a general shape of an elongated cylinder with a first notch near a first end and a bore in the first notch substantially at right angles to the longitudinal axis, the bore proceeding from the notch to an outer surface of the elongated cylinder, and a second end including second and third notches taken in a direction perpendicular to the first notch, such that a shape of the second end is a rounded rectangle or square, and further including a bore substantially in the center of the second end. The system also includes at least one leg spoke, the leg spoke having a longitudinal axis with a first notch near a first end and a bore in the notch substantially at right angles to the longitudinal axis, the bore proceeding from the notch to an outer surface of the first end, and a second end further including a bore in the longitudinal direction and substantially in the center of the second end, and a cross brace having a longitudinal axis, the cross brace in a shape of a flat rectangle having a first flat end with a longitudinal bore substantially in the center of the first flat end, and a second end, and further including a bore through the cross brace at about a right angle to the longitudinal axis.

Another embodiment is a method for preparing a structure. The method includes furnishing a hub in a generally polygonal shape and having a plurality of faces, each face further including a bore, the hub also including a top face and a bottom face, at least one of the top and bottom faces including a bore, joining the hub to a plurality of spokes selected from the group consisting of leg spokes and hub spokes with dowels to form a structure. The method also includes optionally bracing the structure with a plurality of cross braces and dowels, wherein the dowels join the hub, the spokes and the braces by inserting dowels in bores or orifices in the hub, the spokes, and the braces.

Additional features and advantages are described herein, and will be apparent from, the following Detailed Description and the figures.

BRIEF DESCRIPTION OF THE FIGURES

FIG. 12 discloses additional structural members; and

DETAILED DESCRIPTION

Figure 1:
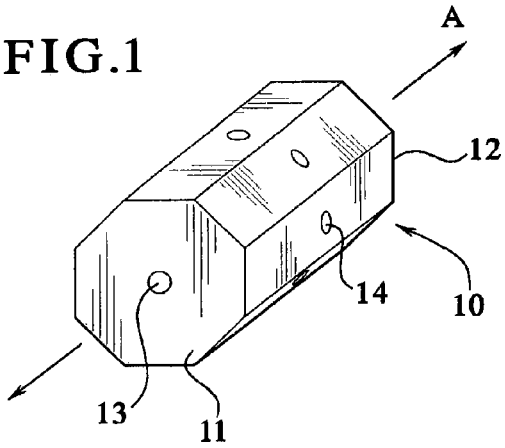
FIGS. 1-2 are perspective view of hub embodiments.

There are many embodiments of the present invention, of which this application presents only a few. One embodiment includes an elongated hub for use in a modular structural system, as shown in FIG. 1. An elongated hub 10 along longitudinal axis A has a generally polygonal cross-section, in this instance of an octagon. Each hub 10 has two end faces 11, of which only one is shown. End face 11 has a hole 13 or bore in about the center of the face. The bore may be of any dimension, but those in FIG. 1 are preferably about ¼ inch in diameter. Other bore dimensions may be used. Each side face 12 of the eight side faces has a transverse bore 14, and is also about ¼ inch in diameter. In the embodiment of FIG. 1, bores 12, 14 are each about ½ inch to about ⅝ inch deep and interconnect at the center of the hub. In other embodiments, the bores are blind, and are about ⅜ inch to ½ inch deep.

Figure 2A:
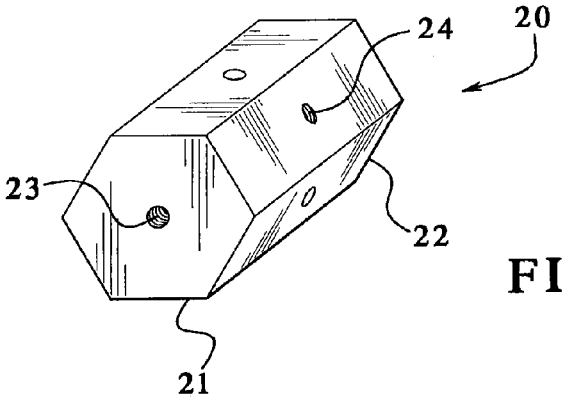
Figure 2B:
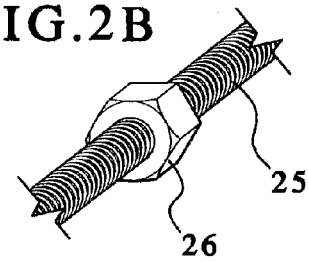
Figure 2C:
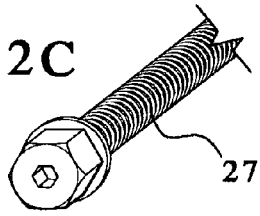

Embodiments of the central hub are not limited to those having a generally octagonal cross-section. FIG. 2 depicts a second embodiment, central hub 20 having a cross-section in the general shape of a hexagon. Central hub 20 has two end faces 21, each with a blind hole bore 23 about ½ inch deep. Central hub 20 has six side faces 22, each with a blind hole bore 24 also about ½ inch deep. In this embodiment, each bore 23, 24 is about ¼ in diameter and does not intersect with other bores in the center of the central hub. Embodiments are not limited to generally polygonal structures with an even number of sides, and other embodiments may have an odd number of sides. Each side preferably has a tapped bore in order to accommodate a connection to another threaded piece of the present modular structural system. As will be seen below, pieces of the modular structural system are preferably joined with wooden dowels, steel or aluminum rods, or other connecting or linking pieces. In this embodiment, threaded steel or aluminum rods are preferably used to connect with hub 20. For example, threaded rod 25, with optional nut 26 may be used to join two pieces. A bolt or a screw, such as socket head cap screw 27, may also be used to join pieces. The head, which will be external to the joint, may be used to help hold or maneuver the structure.

Figure 3A:
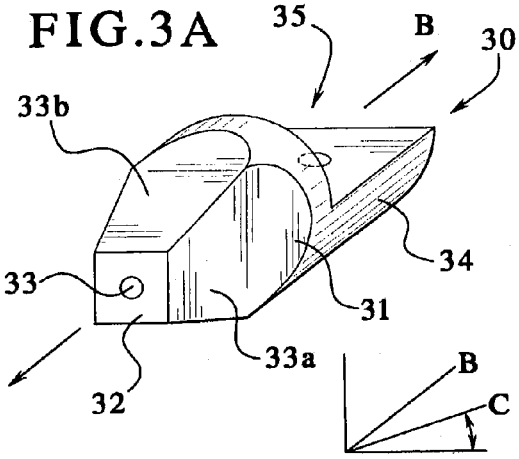
FIG. 3 is a perspective front and back view of a hub spoke embodiment.
Figure 3B:
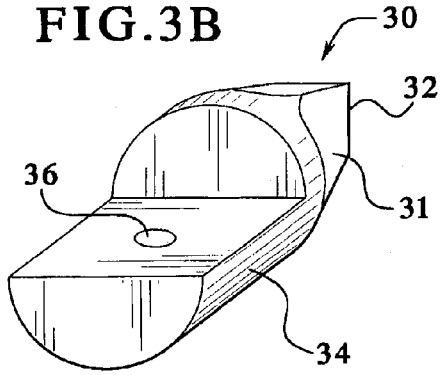

Another structural element or piece that forms a part of the present modular structural system is a hub spoke that joins with the central hub. Hub spokes will radiate from side faces of the central hub. An embodiment of a hub spoke is depicted in FIG. 3. Hub spoke 30 is in the general shape of a modified, elongated cylinder along longitudinal axis B. Hub spoke 30 has a hub-end or front portion 31 and a rear portion 34. Rear portion 34 has a notch 35 in the general form of a half-cylinder, i.e., about half the material removed. Rear portion 34 also has an orifice 36, preferably a through-hole, in about the center of the rear portion.

Front portion 31 has a front face 32 in the general form of a rounded rectangle or square, surrounded by four trimmed side faces 33*a*, 33*b* (only 2 shown) and with a blind hole or orifice 33. In the present orientation, left and right side faces 33*a* are at an angle of about 45 degrees to a vertical plane passing through longitudinal axis B, depicted in FIG. 3 as angle C in a horizontal plane passing through axis B. Trimming the faces in this way allows a plurality of hub spokes 30 to connect with central hub 10. Top and bottom trimmed faces 33*b* are at a similar angle in a transverse plane. In other embodiments, angle B may be at about 60 degrees for a central hub having a cross section in the general shape of a hexagon, as for central hub 20. Other hub spokes may be shaped at different angles for hubs having other shapes. With the extra room allowed by trimming facets on both sides, and on the top and bottom, hub spoke 30 allows great freedom of design with the modular structural system.

Persons having skill in the art will recognize that the hub spokes are trimmed at an angle to enable close placement of as many hub spokes as there are faces on the central hub. If a hub with a cross section in the general shape of a polygon of n sides is used, each face of the hub will portend an angle of 360°/n. Working through the geometry of a shape of a cross-section of a general polyhedron or trapezoid formed at the hub end of a hub spoke, angle required for close-fitting of the hub spokes will be equal to the angle subtended by each face of the central hub. Thus, for an octagonal shape, a trim angle of about 45° is used, while for a hexagonal shape, an angle of 60° will be used. It will be understood that each of these is a maximum angle, and that more trimming may be used, which will result in a smaller angle. Using a greater angle (less trimming) will result in an interference, in which case hub spokes will not be able to fit together. Using a lesser angle (more trimming) will result in voids between the left and right side faces 33*a* and the corresponding faces of adjacent hub spokes. Thus, in the present embodiment of an octagonal hub, the side faces of the hub spokes would be trimmed at a 45° angle which is taken in the horizontal plane to the longitudinal axis B.

Figure 4A:
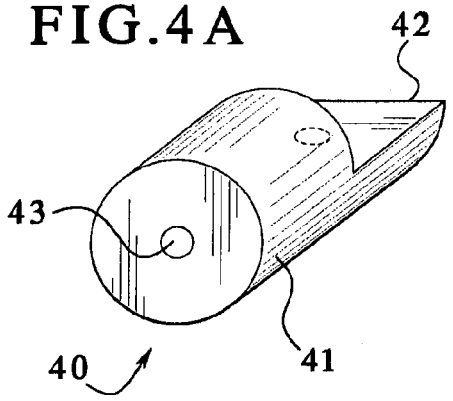
FIG. 4 depicts perspective views of a first leg spoke embodiment.
Figure 4B:
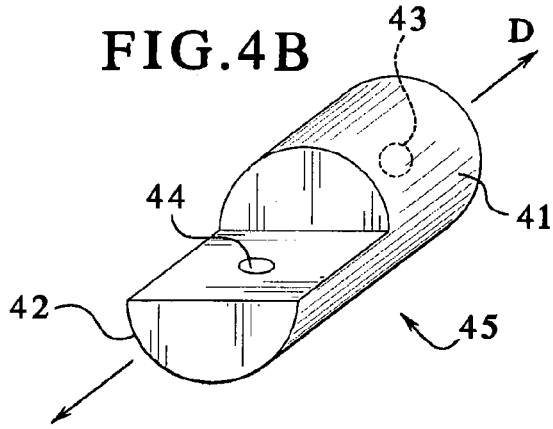
Figure 5A:
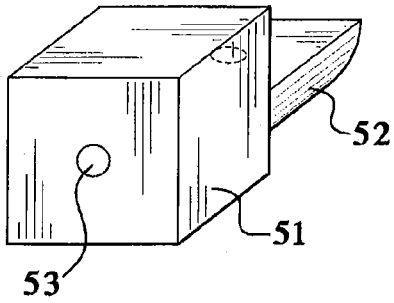
FIG. 5 is a perspective front and back view of a second leg spoke embodiment.
Figure 5B:
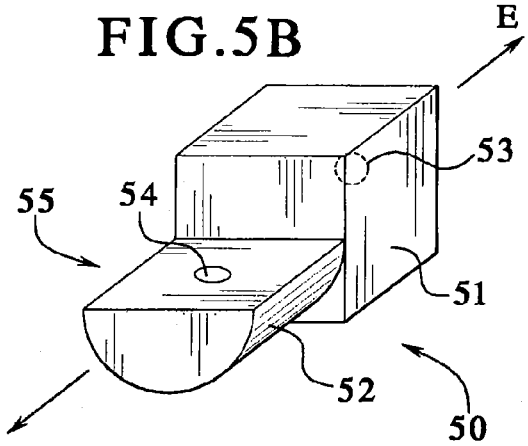

Another element of the present modular structural system is a leg spoke, as depicted in FIGS. 4-5. A first embodiment, in FIG. 4, is a leg spoke 40 which is similar in structure to the hub spokes described above, but in which the front portion is not trimmed because the leg spoke is not intended for close fitting to a central hub. Leg spoke 40 is in the general shape of an elongated cylinder with a longitudinal axis D. Leg spoke 40 includes a front portion 41 with a blind hole or orifice 43. Rear portion 42 has a notch 45, with about half the material removed, and a through hole or orifice 44. Removing half the material leaves rear portion 42 in the general shape of a half-cylinder, while front portion 41 has the general shape of a cylinder.

Another embodiment of a leg spoke is depicted in FIG. 5 Leg spoke 50 includes a front portion 51 in the general shape of a cube with a blind orifice or hole 53 and a rear portion 52. Rear portion 52 is in the general shape of a half-cylinder with a through-orifice 54 and a notch 55. Leg spoke 50 has a longitudinal axis E running in the direction of the front and back portions 51, 52. Rear portion 52 is centered on front portion 51. Orifice 53 runs along longitudinal axis E and orifice 54 is transverse to longitudinal axis E.

Figure 6A:
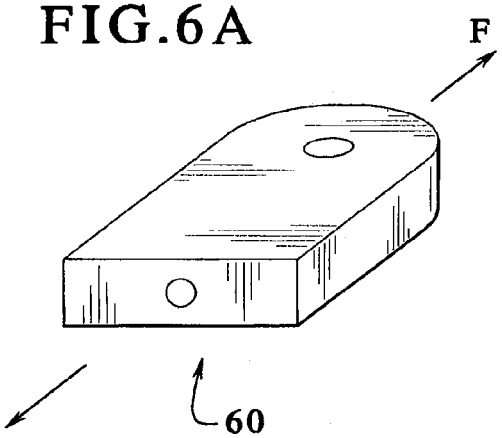
FIG. 6 is a perspective front and back view of a cross brace embodiment.
Figure 6B:
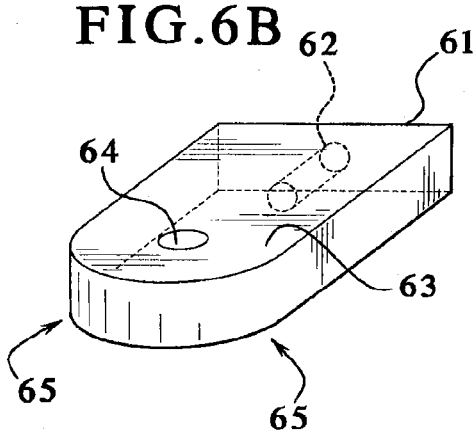

Another element of the present modular structural system is a leg brace, depicted in FIG. 6. Leg brace 60 is flat and has the general shape of a slice of bread along longitudinal axis F. The front portion 61 has a generally boxy shape, while rear portion 63 is rounded, especially at the "corners" 65. Front portion 61 has a blind hole or orifice 62 along the longitudinal axis F, while rear portion 63 has a through orifice 64 that is transverse to the longitudinal axis and is placed through the shorter through-dimension or thickness of the leg spoke. Other configurations of a cross-brace may be used. The above elements, members of the present modular structural system, may be used alone or in combination with available structural members, such as channels and angle pieces, to construct useful structures.

Figure 7:
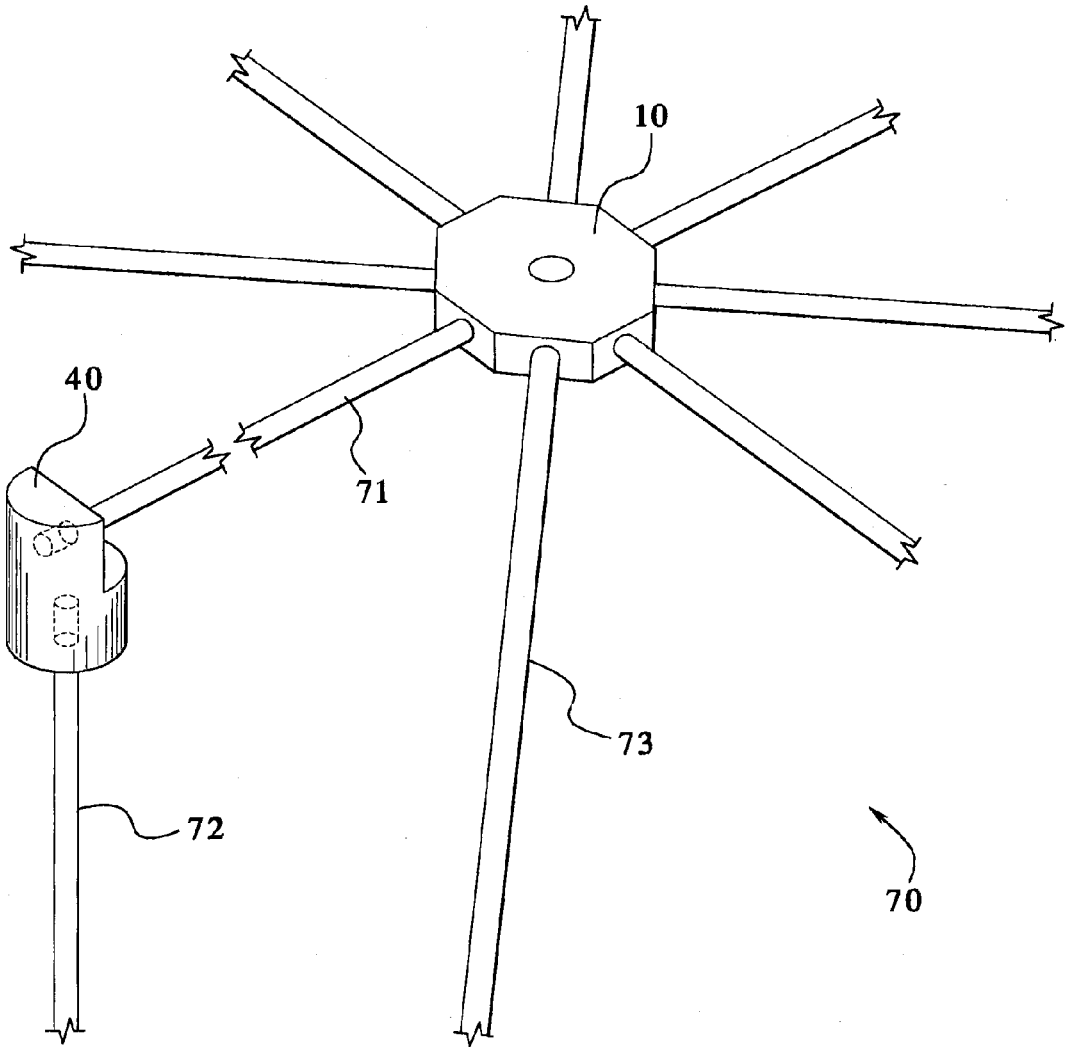
FIG. 7 is a perspective view of a particular application in a garden or greenhouse of a structure using the modular structural system.
Figure 8:
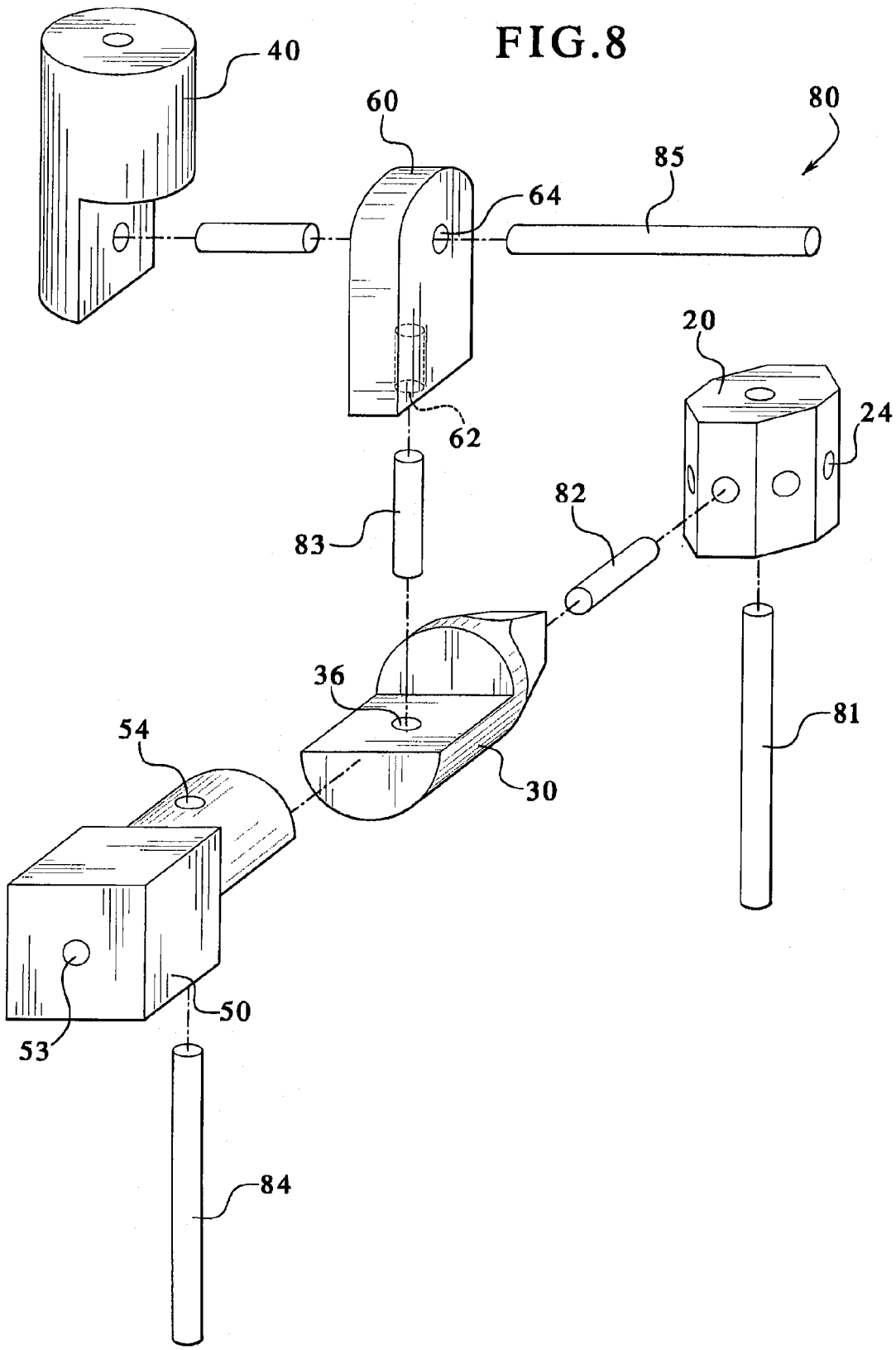
FIG. 8 is a perspective view of a second particular application of a structure using the modular structural system.

Two applications using embodiments of the modular structural system are presented in FIGS. 7-8. FIG. 7 depicts a trellis 70 for supporting climbing vines or other decorative objects, such as flowers or art work, such as children's projects. Trellis 70 includes an eight-sided central hub 10 connected with short dowels 71, the dowels in this case about 1-2 feet long. This particular central hub 10 is a little less high, but still has the requisite number of sides, each side with an orifice. This embodiment also has an orifice on the top and bottom faces. Each dowel 71 connects to a leg spoke 40, the leg spoke having a side orifice for connecting with dowels 71. The leg spoke, in this orientation, also has a down-ward facing orifice for connecting with dowel 72. Central hub 10 also has a down-ward facing orifice, as described previously, for interfacing with supporting dowel 73. Dowels 72 and 73 are preferably sufficiently long that they can be pushed into the earth a reasonable distance, such as at least 8-12 inches. This distance will provide support for the leg spokes and hub, and will allow the structure good support in a breeze or other mild weather events.

FIG. 8 depicts a sturdier structure 80 for supporting a tomato plant in a garden. Support structure 80 includes a central hub 20 in a generally hexagonal shape with a central support dowel 81 for placement in the orifice (not shown) in the bottom face of central hub 20 and also in the ground. Six hub spokes 30, one for each face of hub 20 with bore 24, interface with central hub 20 via dowels 82, each dowel about 6-8 inches long. Each hub spoke 30 interfaces with a short dowel 83, about 2 inches long, and joining the hub spoke to a leg spoke 50 via bore 54 and to a cross brace 60 via bore 64. The leg spokes are supported above the ground by bent or angled rods 84 joined to leg spokes 50 through orifice 53. The cross braces 60 and the structure are reinforced by joining dowels 85, each dowel 85 joining two adjacent cross braces through bore 64. In one embodiment, one structure 80 is used to support a single tomato plant.

Other features may also be used with the structure as shown. For example, an additional leg spoke 40 may be joined horizontally to cross brace 60. Note that the "top" portion of the cross brace, when joined to leg spoke 40 through their respective bores, allows rotation or pivoting of the cross brace within the notch of the leg spoke. Note that if aluminum or steel modular pieces are used to construct the tomato plant holder 80, the joinder may be made permanent by simply spot-welding, brazing, or soldering the joints of the individual pieces. If wooden pieces are used, the structure may be made permanent by using any suitable adhesive or wood glue to join the pieces.

Figure 9:
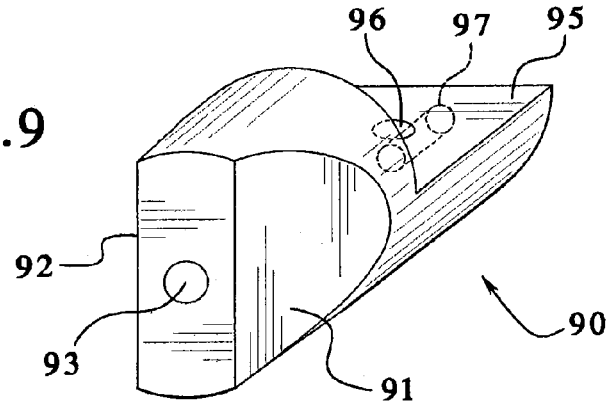
FIG. 9 is a perspective view of another embodiment of a hub spoke.

There are many embodiments of the present modular structural system. Another embodiment is depicted in FIG. 9, which discloses an additional hub spoke 90. Hub spoke 90 has a forward portion with only two trimmed opposite faces 91, 92, and orifice 93, so that the forward portion faces may fit around a generally polygonal central hub, as described above. The hub spoke also has a rearward notch 95, a transverse orifice 96, and an axial orifice 97. Trimming only two faces allows fewer hub spokes to be clustered about the central hub, while still allowing orientation of the spoke and the hub in a different direction.

Figure 10:
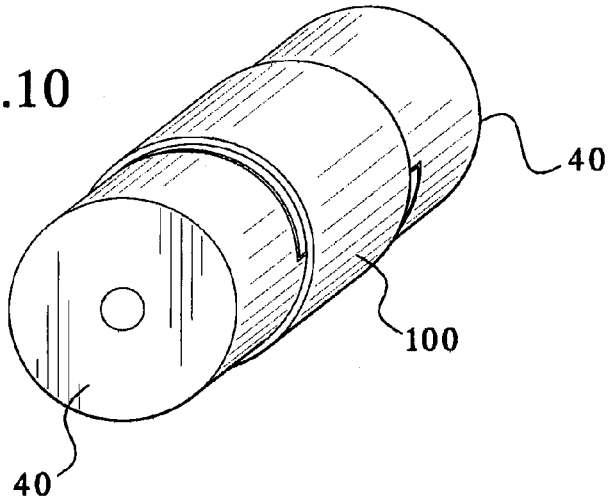
FIGS. 10-11 disclose braces for reinforcing modular structures.
Figure 11:
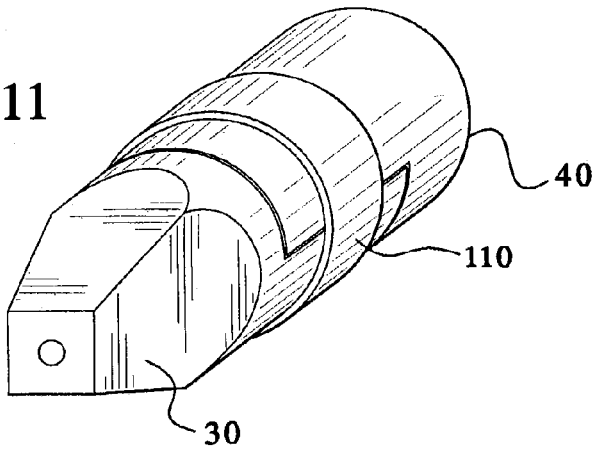

There are also other ways to stiffen or reinforce structures made from the modular structural system. For example, thin steel or aluminum tubing may be used, as shown in FIG. 10, in which tube 100 is crimped around two leg spokes 40. This will stiffen the joint between the individual spokes and make the assembly stiffer and stronger. Instead of metal tubing, plastic bands, similar to wide wire-ties, or shrink-wrap tubing, may be used, preferably with wooden pieces as shown in FIG. 11, although shrink-wrap tubing may also be used with metal embodiments. The bands may extend merely to one joint, or may encompass more than one joint.

Figure 13:
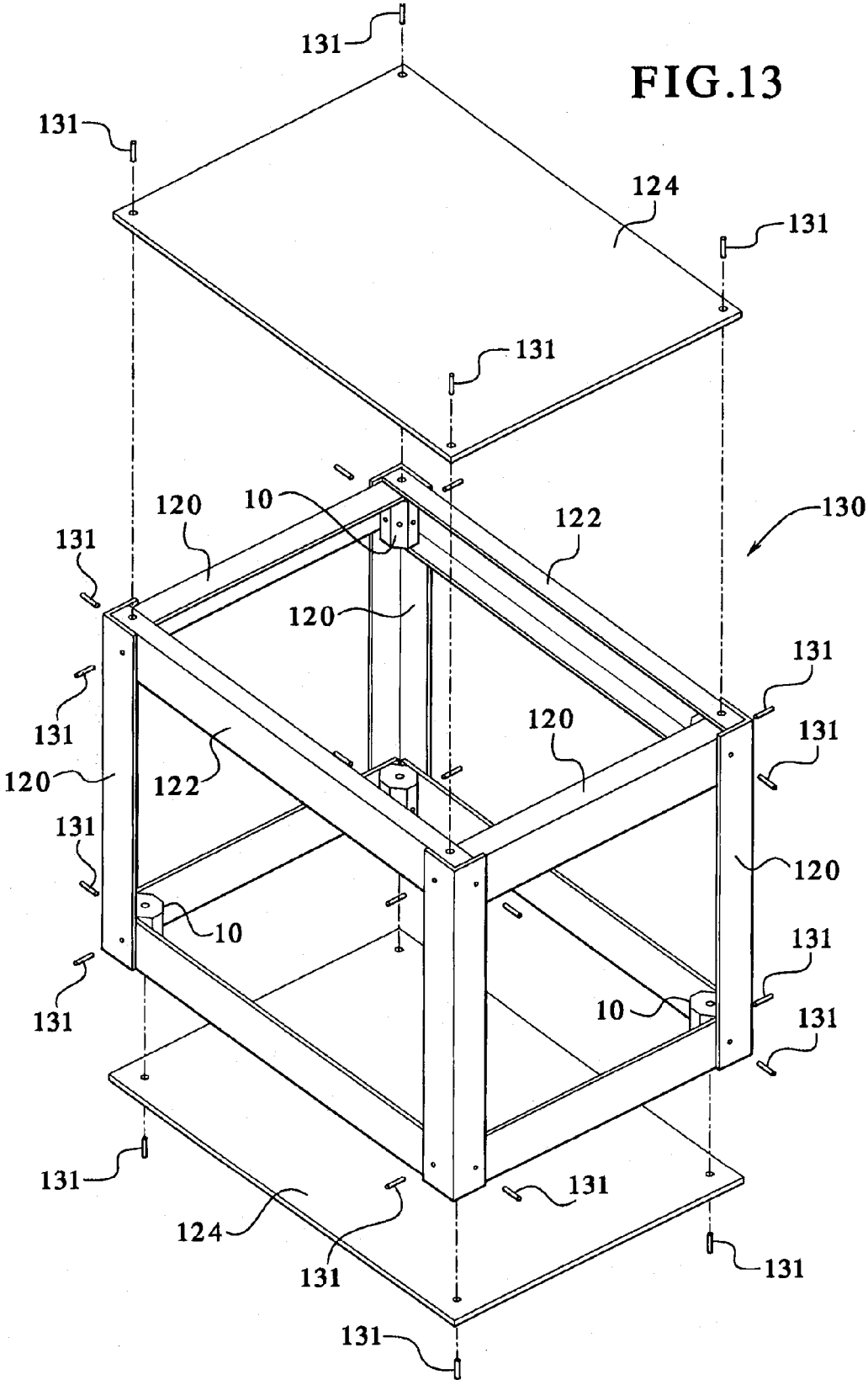
FIG. 13 is an embodiment of a structure made from the modular structural system.

Finally, there are many structures which may be made from the modular structural system. As noted above, the elements of the present modular structure system may be used with available structural members to construct or build useful structures. Examples of steel and aluminum, disclosed in FIGS. 12A-12C, include angle-pieces 120 and channels 122. Examples of available wooden structural members include board 124. Inside-plant holder 130, depicted in FIG. 13, is one example of these structures, using octagonal hubs 10 and dowels 131 with other structural members, including angle-pieces 120, channels 122, and boards 124. The bottom board 124 in FIG. 13 could be placed atop the bottom set of hubs 10, rather than underneath. The board is shown underneath for clarity in the figure. Other embodiments include stairway guard rails, awning holders, structures for holding shelving, outdoor greenhouse structures, lean-tos, space-holders, and so forth.

It should be understood that various changes and modifications to the presently preferred embodiments described herein will be apparent to those skilled in the art. For instance, the hub pieces are generally in the shape of a polygon, such as a triangle square, pentagon, hexagon, or octagon. It is often more convenient, and safer for users, to manufacture such pieces with rounded corners, such that there is no longer a truly polygonal cross-section or shape. These rounded shapes are included in the meaning of the term "polygonal," or specific embodiments, such as "hexagonal" or "octagonal." The same rounding may apply to other pieces of this modular system. Such changes and modifications can be made without departing from the spirit and scope of the present subject matter and without diminishing its intended advantages. It is therefore intended that such changes and modifications be covered by the appended claims.

What is claimed is:

1. A modular structural system, comprising:

an elongated hub having a generally elongated polygonal shape, and further comprising a longitudinal axis and a plurality of faces on a perimeter of the hub, the faces oriented along the axis, the hub also comprising two ends, and wherein each face and at least one end further comprises a bore;

at least one hub spoke, the hub spoke having a longitudinal axis and comprising a general shape of an elongated cylinder, an elongated cube or an elongated rectangle, with a first notch on a first end and a bore in the first notch substantially at right angles to the longitudinal axis, the bore proceeding from the notch to an outer surface of the first end, and a second end comprising second and third notches taken in a direction perpendicular to the first notch, such that the second end has a general shape of a rounded rectangle or square, and further comprising a bore substantially in the center of the second end;

at least one leg spoke, the leg spoke having a longitudinal axis and comprising a general shape of an elongated cylinder, an elongated cube, or an elongated rectangle, with a first notch on a first end and a bore in the notch substantially at right angles to the longitudinal axis, the bore proceeding from the notch to an outer surface of the first end, and a second end further comprising a bore in the longitudinal direction and substantially in the center of the second end; and a cross brace having a longitudinal axis, the cross brace in a general shape of a flat rectangle having a first flat end with a longitudinal bore substantially in the center of the first flat end, and a second rounded end, and further comprising a bore through the cross brace at about a right angle to the longitudinal axis.

2. The system of claim 1, wherein the hub comprises six or eight faces and the ends are substantially in the shape of a hexagon or octagon.

3. The system of claim 1, wherein the second and third notches in the hub spoke are taken at an angle dependent on the plurality of faces of the elongated hub.

4. The system of claim 1, wherein the first notch in the hub spoke is taken at about a right angle to the longitudinal axis of the hub spoke.

5. The system of claim 1, wherein the second and third notches in the hub spoke are taken at an angle to allow positioning of six or eight hub spokes around a perimeter of the hub.

6. The system of claim 1, wherein the notch of the leg spoke is taken at about a right angle to the longitudinal axis of the leg spoke.

7. The system of claim 1, wherein the first end of the leg spoke has a shape of a half-cylinder and the second end has a shape of a circular cross-section with a bore.

8. The system of claim 1, wherein the cross brace has the shape of a tombstone.

9. The system of claim 1, wherein the second rounded end of the cross brace is in the form of a half circle with the bore through the cross brace located at about a center of the circle.

10. The system of claim 1, wherein at least two elements of the modular structural system are configured for assembly to each other: i. with a plurality of dowels, and further comprising a plurality of dowels; or ii. with a plurality of threaded fasteners, and further comprising a plurality of threaded fasteners.

11. The system of claim 1, wherein elements of the system are combined to form a structure.

12. A modular structural system, comprising:

a hub having a longitudinal axis and a plurality of faces on a perimeter of the hub, the faces oriented along the axis, the hub also comprising two ends, wherein a plurality of faces and each end further comprises a bore;

at least one hub spoke, the hub spoke having a longitudinal axis and comprising a general shape of an elongated cylinder with a first notch near a first end and a bore in the first notch substantially at right angles to the longitudinal axis, the bore proceeding from the notch to an outer surface of the elongated cylinder, and a second end comprising second and third notches taken in a direction perpendicular to the first notch, such that a shape of the second end is a rounded rectangle or square, and further comprising a bore substantially in the center of the second end;

at least one leg spoke, the leg spoke having a longitudinal axis with a first notch near a first end and a bore in the notch substantially at right angles to the longitudinal axis, the bore proceeding from the notch to an outer surface of the first end, and a second end further comprising a bore in the longitudinal direction and substantially in the center of the second end; and a cross brace having a longitudinal axis, the cross brace in a shape of a flat rectangle having a first flat end with a longitudinal bore substantially in the center of the first flat end, and a second end, and further comprising a bore through the cross brace at about a right angle to the longitudinal axis.

13. The modular structural system of claim 12, wherein the second and third notches in the hub spoke are taken from an outer surface of the second end toward a center of the hub spoke, a depth of the notch decreasing as the second and third notches near the center of the hub spoke.

14. The modular structural system of claim 12, wherein the second and third notches in the hub spoke are taken at an angle dependent on the plurality of faces of the elongated hub.

15. The modular structural system of claim 12, wherein the hub spoke further comprises at least a fourth or a fifth notch, the fourth and fifth notches taken from an outer surface of the second end toward a center of the hub spoke and in a direction generally perpendicular to the first notch and also perpendicular to the second and third notches, and generally along a direction of the longitudinal axis.

16. The modular structural system of claim 12, further comprising a reinforcement for joints between elements of the modular structural system, the reinforcement selected from the group consisting of tubing, shrink-wrap tape, and plastic bands.

17. The modular structural system of claim 12, further comprising an available structural member, wherein the system is configured for joining to the available structural member.

18. A method of preparing the structural system of claim 1 to form a structure, the method comprising:

furnishing at least one hub; and joining the at least one hub to a plurality of spokes selected from the group consisting of the leg spokes and the hub spokes with dowels to form a structure.

19. The method of claim 18, wherein the hub comprises an elongated generally hexagonal or octagonal shape.

20. The method of claim 18, wherein the structure is supported above ground by a plurality of rods or dowels.

21. The method of claim 18, further comprising either reinforcing joints between at least two elements of the structure, the elements selected from the group consisting of a plurality the hubs, the leg spokes, the hub spokes and the cross braces or bracing the structure with a plurality of the cross braces and dowels, wherein the dowels join the at least one hub, the spokes, and the braces by inserting the dowels in the bores or orifices in the hub, the spokes, and the braces.

22. The method of claim 18, further comprising reinforcing joints between elements of the structure with external tubing, shrink-wrap tape, or plastic bands.

23. The method of claim 18, further comprising joining elements of the structure to an available structural member.

24. The method of claim 18, further comprising joining elements of the structure permanently by a method selected from the group consisting of gluing, welding, brazing, and soldering.

* * * * *